US006685240B2

(12) United States Patent
Bacon

(10) Patent No.: US 6,685,240 B2
(45) Date of Patent: Feb. 3, 2004

(54) ROTARY PADDLE HANDLE ASSEMBLY

(75) Inventor: Bruce C. Bacon, Rockford, MI (US)

(73) Assignee: Bauer Products, Inc., Grand Rapids, MI (US)

( * ) Notice: Subject to any disclaimer, the term of this patent is extended or adjusted under 35 U.S.C. 154(b) by 0 days.

(21) Appl. No.: 10/207,510

(22) Filed: Jul. 29, 2002

(65) Prior Publication Data

US 2002/0180220 A1 Dec. 5, 2002

Related U.S. Application Data

(63) Continuation-in-part of application No. 09/501,121, filed on Feb. 9, 2000.

(51) Int. Cl.[7] ..... E05B 3/00
(52) U.S. Cl. ..... 292/336.3; 292/142; 296/37.5
(58) Field of Search ..... 292/DIG. 31, 336.3, 292/347, DIG. 43, 39, 51; 296/37.5, 37.6

(56) References Cited

U.S. PATENT DOCUMENTS

| | | | | |
|---|---|---|---|---|
| 374,391 | A | | 12/1887 | Born |
| 745,042 | A | | 11/1903 | Daves |
| 1,071,567 | A | | 8/1913 | Outwater |
| 1,964,066 | A | | 6/1934 | Kuszmaul |
| 2,112,372 | A | | 3/1938 | Lofgren |
| 2,202,056 | A | | 5/1940 | Kandetzki |
| 2,241,785 | A | | 5/1941 | Lofgren |
| 2,263,180 | A | | 11/1941 | Lofgren |
| 2,322,948 | A | | 6/1943 | Lofgren |
| 2,324,406 | A | | 7/1943 | Lofgren et al. |
| 2,987,908 | A | | 6/1961 | Pelcin |
| 3,080,743 | A | | 3/1963 | Stansberry |
| 3,283,549 | A | | 11/1966 | Mees |
| 3,514,979 | A | | 6/1970 | Wiesmann |
| D218,672 | S | | 9/1970 | Lauper |
| 3,782,141 | A | | 1/1974 | Doerrfeld |
| 4,052,092 | A | * | 10/1977 | Bergen ..... 292/172 |
| 4,309,884 | A | | 1/1982 | Davis |
| 4,420,954 | A | | 12/1983 | Hieronymi et al. |
| D281,665 | S | | 12/1985 | Weinerman et al. |
| 4,725,085 | A | | 2/1988 | Hu et al. |
| 4,732,417 | A | | 3/1988 | Yang |
| 4,850,209 | A | | 7/1989 | Weinerman et al. |
| D303,617 | S | | 9/1989 | Russell et al. |
| D303,618 | S | | 9/1989 | Russell et al. |
| D303,922 | S | | 10/1989 | Russell et al. |
| D304,155 | S | | 10/1989 | Russell et al. |
| 4,934,800 | A | | 6/1990 | Choi |
| D314,131 | S | | 1/1991 | Russell et al. |
| 5,042,853 | A | | 8/1991 | Gleason et al. |
| 5,058,937 | A | | 10/1991 | Miehe et al. |
| 5,060,991 | A | | 10/1991 | Davidian et al. |
| D339,050 | S | | 9/1993 | Gleason et al. |
| 5,299,844 | A | | 4/1994 | Gleason |
| 5,301,989 | A | | 4/1994 | Dallmann et al. |
| D346,731 | S | | 5/1994 | Larsen et al. |
| D369,084 | S | | 4/1996 | McConnell et al. |
| D371,500 | S | | 7/1996 | McConnell et al. |
| 5,531,498 | A | * | 7/1996 | Kowall ..... 296/146.4 |
| D373,298 | S | | 9/1996 | Miehe et al. |
| 5,564,295 | A | | 10/1996 | Weinerman et al. |
| 5,586,795 | A | | 12/1996 | Sasaki |
| 5,595,076 | A | | 1/1997 | Weinerman et al. |
| 5,611,227 | A | * | 3/1997 | Solovieff ..... 70/472 |

(List continued on next page.)

*Primary Examiner*—Gary Estremsky
(74) *Attorney, Agent, or Firm*—Price, Heneveld, Cooper, DeWitt & Litton

(57) ABSTRACT

A rotary paddle handle assembly for vehicle closures and the like includes a horizontally pivoting handle with a tab, a vertically reciprocating rack disposed adjacent the tab and a pinion engaged with the rack. The pinion is configured for operable connection with an associated latch, such that when the handle is lifted, the tab shifts the vertically reciprocating rack and rotates the pinion for unlocking the latch.

38 Claims, 4 Drawing Sheets

U.S. PATENT DOCUMENTS

D390,086 S 2/1998 Weinerman et al.
D394,373 S 5/1998 Weinerman et al.
5,927,773 A 7/1999 Larsen et al.
6,138,883 A * 10/2000 Jackson ..... 224/404
6,203,086 B1 * 3/2001 Dirks ..... 296/37.6
6,220,649 B1 * 4/2001 Rife ..... 296/146.12
6,257,030 B1 * 7/2001 Davis ..... 70/107

* cited by examiner

ROTARY PADDLE HANDLE ASSEMBLY

CROSS-REFERENCE TO RELATED APPLICATIONS

The present application is a continuation-in-part of commonly assigned, copending U.S. patent application Ser. No. 09/501,121, filed Feb. 9, 2000, entitled ROTARY PADDLE ASSEMBLY, which is hereby incorporated herein by reference.

BACKGROUND OF THE INVENTION

The present invention relates to paddle handles, and in particular to a rotary paddle handle assembly for vehicle covers, access closures and the like.

Paddle handles are used extensively for opening points of ingress, egress, storage, etc. for vehicles. The paddle handles are attached to closure latches for windows, doors, tailgates, etc. of the vehicle and allow the same to be opened from outside and/or inside of the vehicle.

Heretofore, designs for paddle handles have included pop-up T-handles and cam systems for opening the door or other entryways to a vehicle. The pop-up T-handles are pulled out of the surface of the entryways and rotated to unhook a latch that locks the entryway to the vehicle, thereby opening the entryway. The pop-up T-handles, however, can be aesthetically displeasing as they do not look like the factory installed paddle handle connected to the side doors or tailgate of the vehicle. The paddle handles with the cam systems can rotated outward, thereby pushing downward on a cam engaged with the back of the paddle handle. The cam has a central pivot, and the cam rotates when the paddle handle is lifted. The cam has also been attached to a latch that engages with the vehicle body, thereby locking the door. The latch rotates to be behind the paddle handle when the paddle handle is rotated and unlocks the door. Cams have also been designed with a latch that has two opposite openings on two sides of the cam. The openings are attached to two pins that have free ends located in holes in the vehicle body, thereby locking the door to the vehicle body. The two pins move toward the cam when the cam is rotated, thereby removing the pins from the vehicle and unlocking the door. However, the cam systems for opening doors can be very restricted when the handles, the cams and the remote latches are in the same plane.

Accordingly, an apparatus solving the aforementioned disadvantages and having the aforementioned advantages is desired.

SUMMARY OF THE INVENTION

One aspect of the present invention is to provide a rotary paddle handle assembly for closure latches that includes a horizontally pivoting handle with a tab, a vertically reciprocating rack disposed adjacent the tab and a pinion engaged with the rack. The pinion is configured for operable connection with an associated latch, such that when the handle is lifted, the tab shifts the vertically reciprocating rack and rotates the pinion for unlocking the latch.

Another aspect of the present invention is to provide a rotary paddle handle assembly for a vehicle having a horizontally pivoting paddle handle with a tab, a vertically reciprocating rack adjacent the tab and a rotating pinion engaged with the rack. The tab vertically moves the vertically reciprocating rack, and the rack rotates a mating pinion when the handle is lifted, thereby opening an entryway of the vehicle.

Yet another aspect of the present invention is a cover or cap for vehicles and the like of the type having at least one releasable latch to secure the cover or latch to an associated vehicle. A rotary handle assembly includes a handle pivotally mounted to the cover for rotation about a generally horizontal axis, and includes a protruding tab. A vertically reciprocating rack is disposed adjacent to the tab, and a pinion engages the rack. A shaft is operably connected with the pinion, extends horizontally in a direction generally perpendicular to the horizontal axis of the handle, and operably connects with the releasable latch, such that when the handle is lifted, the tab abuts the vertically reciprocating rack to shift the same vertically and rotate the pinion and the shaft axially for unlocking the releasable latch to permit opening the cover or cap.

Yet another aspect of the present invention is an access closure for vehicles and the like having at least one releasable latch to selectively secure the closure to an associated vehicle. A rotary paddle handle assembly includes a handle pivotally mounted to the cover for rotation about an axis, and includes a protruding tab. A reciprocating rack is disposed adjacent to the tab, and a pinion engages with the rack. A shaft is operably connected with the pinion, extends generally perpendicular to the axis of the handle, and operably connects with the releasable latch, such that when the handle is rotated, the tab abuts the reciprocating rack to shift the same longitudinally and rotate the pinion and the shaft axially for unlocking the releasable latch to permit opening the closure.

The rotary paddle handle assembly has relatively few parts and can be used to retrofit existing vehicles. The rotary paddle handle assembly also can be opened from the interior of a vehicle even when the paddle handle is locked, thereby providing an additional safety feature. The rotary paddle handle assembly allows the latches to be activated by a handle not in the same plane as the latches, thereby permitting a variety of mounting configurations not available with current paddle handles. The rotary paddle handle is particularly adapted for use in conjunction with covers or caps shaped to enclose an open pickup truck bed. The handle preferably includes a downwardly opening finger recess to facilitate both unlocking the releasable latch and opening the cover with a single upward lifting motion. The rotary paddle handle may have a flush mount construction which visually replicates factory installed entryway handles on the vehicle. The rotary paddle handle assembly is efficient in use, economical to manufacture, capable of a long operable life, and particularly adapted for the proposed use.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
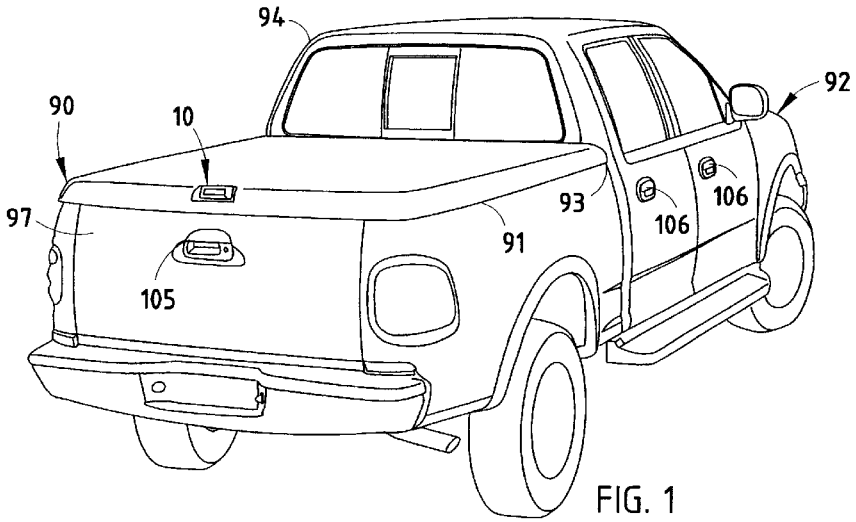
FIG. 1 is a perspective view of a pickup truck having a cover or cap with a rotary paddle handle embodying the present invention.

For purposes of description herein, the terms "upper", "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1–3) generally designates a rotary paddle handle assembly embodying the present invention. Rotary paddle handle assembly 10 includes a horizontally pivoting handle 12 (FIGS. 4–9) with a tab 14, a vertically reciprocating rack 16 disposed adjacent the tab 14 and a pinion 18 engaged with the rack 16. The pinion 18 is configured for operable connection with an associated latch, such that when the handle 12 is lifted, the tab 14 shifts the vertically reciprocating rack 16 and rotates the pinion 18 for unlocking the latch.

The illustrated rotary paddle handle assembly 10 includes a housing 22 that holds or mounts the handle 12. The housing 22 preferably has a vertically arranged substantially rectangular front face 20. The handle 12 is located within a recess 24 in the front face 20 of the housing 22. The recess 24 is preferably centrally located in the front face 20 of the housing 22, although the recess 24 could have an opening at a bottom face 27 of the housing 22. The handle 12 is connected by a pin 25 to the housing 22 through sidewalls 29 of the recess 24. The pin 25 allows the handle 12 to pivot about a horizontal axis of rotation. Therefore, the paddle handle 12 is horizontally pivotal.

The illustrated handle 12 has a vertically arranged planar back wall 26 and a front wall 28 sloping downward and outward from a top edge 30 of the back wall 26. The front wall 28 preferably has a top portion 32 extending substantially horizontally from the top edge 30 of the back wall 26 and a bottom portion 34 that is substantially horizontal. A middle portion 36 of the front wall 28 extends between the top portion 32 and the bottom portion 34, and preferably has a slope with a substantially constant second derivative. The handle 12 also has two sidewalls 38 extending between the back wall 26 and the front wall 28. The handle 12 therefore has a downwardly directed opening or finger recess 39 between the front wall 28 and the back wall 26.

In the illustrated example, the handle 12 is connected to the housing 22 by inserting the pin 25 through a sleeve 37 in the handle 12. The sleeve 37 is located within the opening 39 at the meeting point of the front wall 28 and the back wall 26. The sleeve 37 is also integral with the front wall 28, the back wall 26 and the two sidewalls 38. The handle 12 is connected to the housing 22 by inserting the pin 25 into the sleeve 37, and then inserting the pin 25 into the sidewalls 38 of the recess 24. Therefore, the handle 12 can be rotated around the pin 25 within the recess 24. Moreover, the back wall 26 of the handle 12 has a pad 35 that is flush with the bottom 41 of the recess 24 in the closed position and remote from the bottom 41 of the recess 24 in the closed position. The pad 35 protects the handle 12 from colliding with the bottom 41 of the recess 24 when the handle 12 is in the closed position. Furthermore, the front wall 28 of the handle 12 preferably extends out of the recess 24.

The illustrated handle 12 also has the tab 14 extending horizontally from the back wall 26 in a direction opposite to the front wall 28. The tab 14 is located in the center of the back wall 28 and is aligned with the top edge 30 of the back wall 26. The tab 14 extends through an opening 42 in the bottom 41 of the recess. As to be explained in more detail below, the handle 12 is horizontally pivoted about the pin 25 in order to open an access cover for a vehicle or the like.

Figure 3:
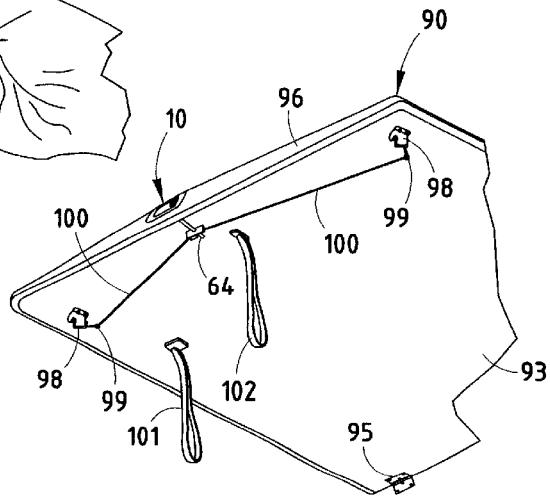
FIG. 3 is a fragmentary perspective view of the vehicle cover or cap, showing the interior construction thereof.
Figure 4:
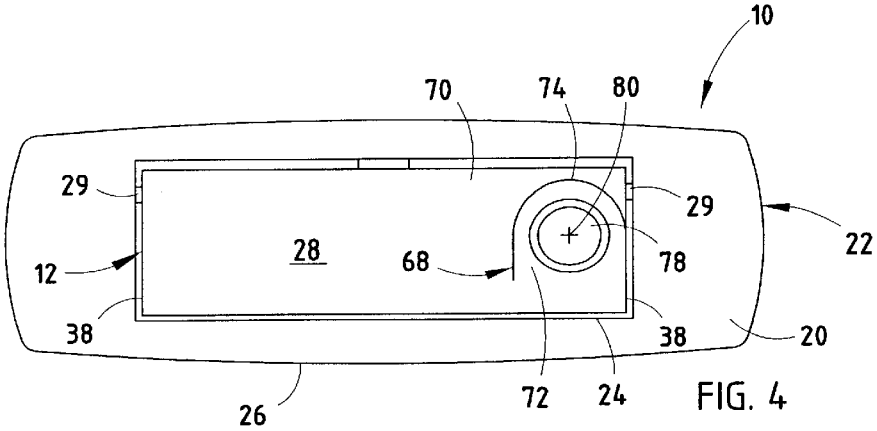
FIG. 4 is a front view of the rotary paddle handle assembly.
Figure 5:
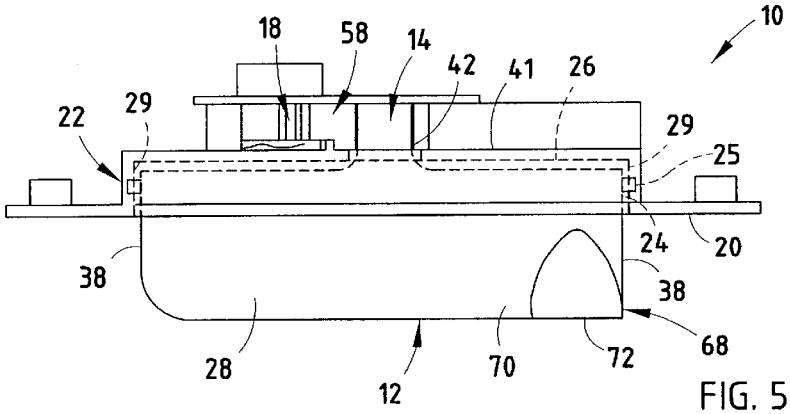
FIG. 5 is a top view of the rotary paddle handle assembly.
Figure 6:
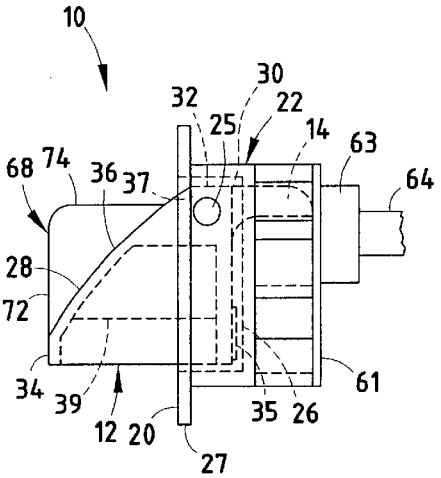
FIG. 6 is a side view of the rotary paddle handle assembly, shown in a closed position.
Figure 7:
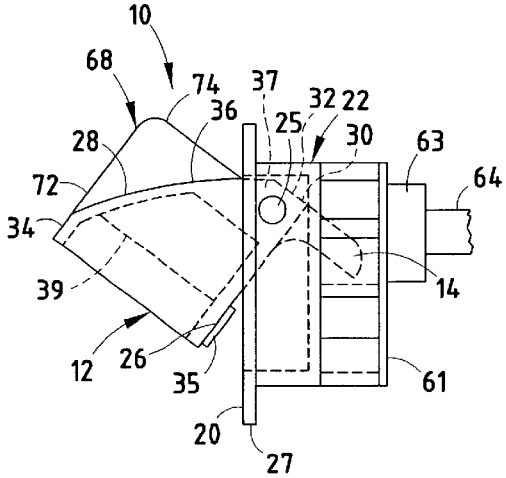
FIG. 7 is a side view of the rotary paddle handle assembly, shown in an open position.
Figure 8:
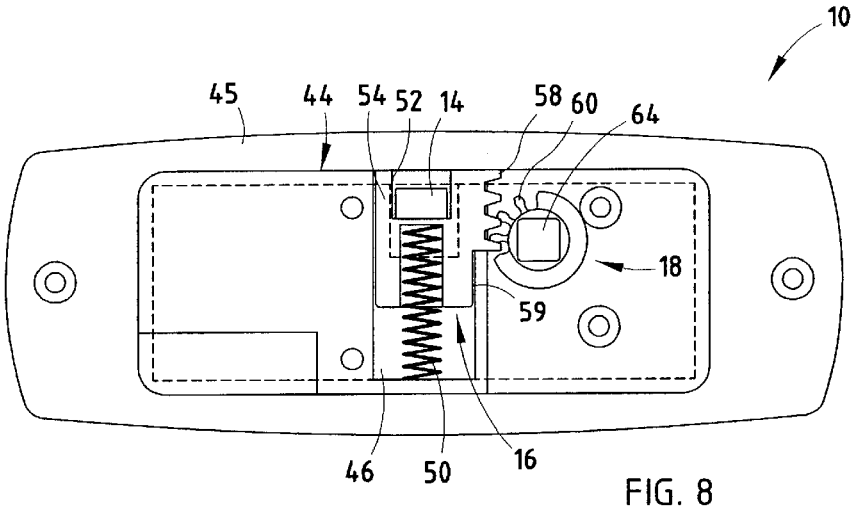
FIG. 8 is a rear view of the rotary paddle handle assembly, shown in the closed position.
Figure 9:
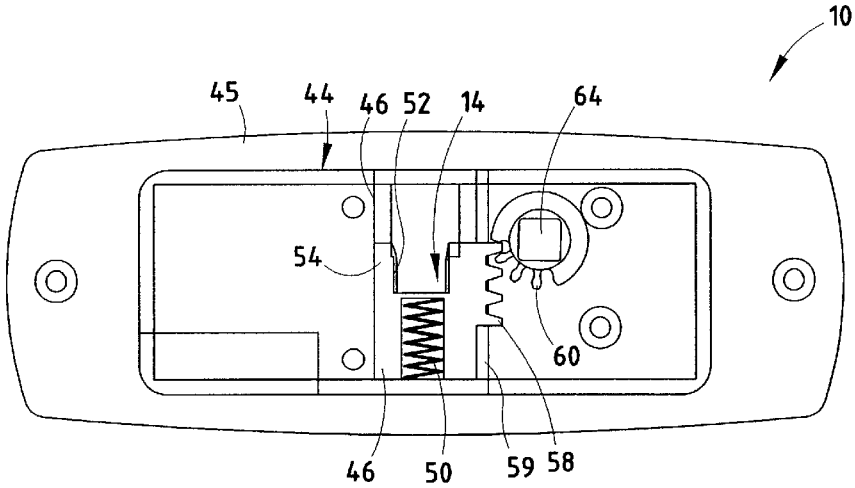
FIG. 9 is a rear view of the rotary paddle handle assembly, shown in the open position.
Figure 10:
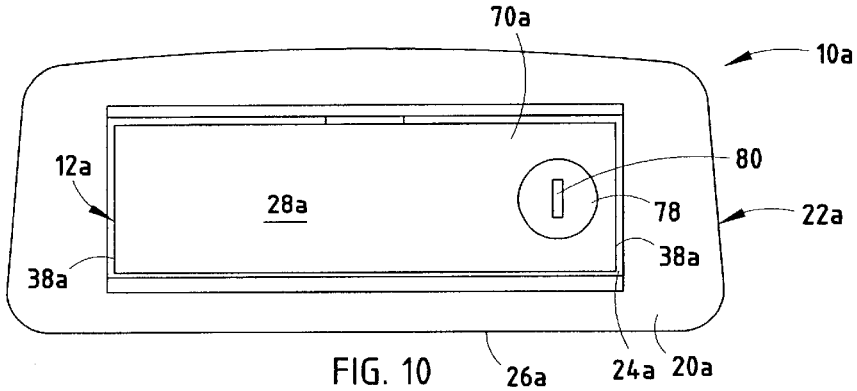
FIG. 10 is a front view of a second embodiment of the present invention.
Figure 11:
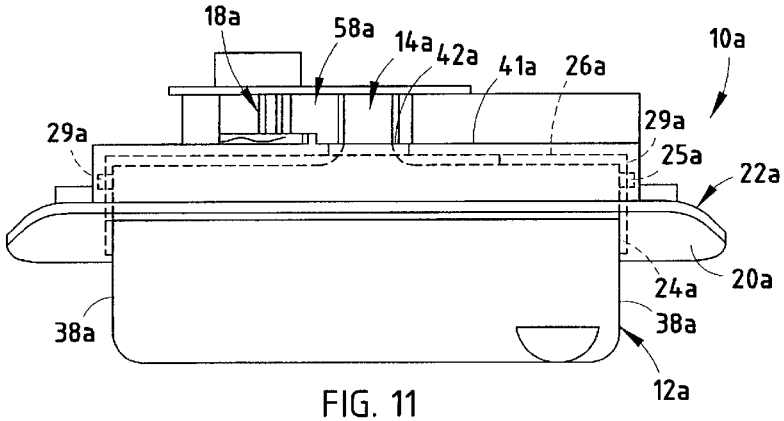
FIG. 11 is a top view of the rotary paddle handle assembly of FIG. 10.
Figure 12:
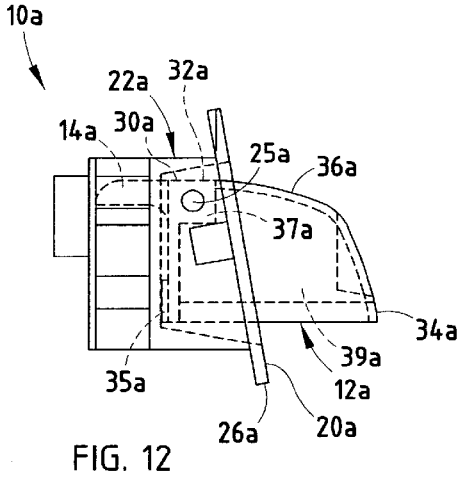
FIG. 12 is a side view of the rotary paddle handle assembly of FIG. 10, shown in a closed position.
Figure 13:
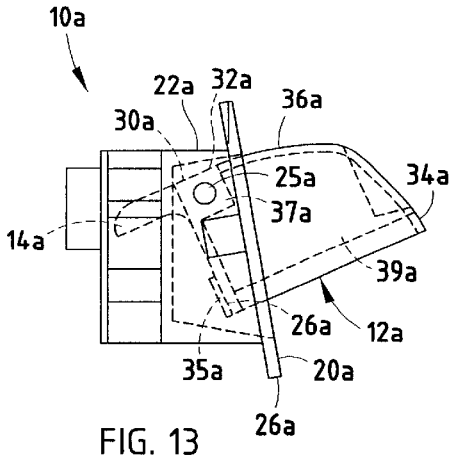
FIG. 13 is a side view of the rotary paddle handle assembly of FIG. 10, shown in an open position.

In the illustrated example, a back 45 of the housing 22 of the rotary paddle handle 10 has a rack frame 44. The rack frame 44 is approximately located in the center of the back 45 of the housing 22 and is aligned with the recess 24. A track 46 is positioned in the center of the rack frame 44, and the opening 42 to the recess 24 opens into the top of the track 46. Therefore, the tab 14 protrudes through the rack frame 44 into the opening 42 at the top of the track 46. Furthermore, the rack 16 is slidably mounted within the track 46 and is allowed to vertically reciprocate within the track 46 between an open position at the bottom of the track 46 (FIGS. 4 and 6) and a closed position at the top of the track 46 (FIGS. 3 and 5). A coil spring 50 is placed with the track 46 below the rack 16, thereby biasing the rack 16 to the closed position. The rack 16 has a notch 52 at a top end 54, wherein a free end of the tab 14 is located within the notch 52. Therefore, when the handle 12 is horizontally rotated, the tab 14 will lower and force the rack 16 to the open position.

The illustrated rack 16 also has a plurality of teeth 58 extending laterally along a side 59 of the rack 16. The teeth 58 are engaged with cogs 60 on a pivotal pinion 18 located in the rack frame 44. The pinion 18 preferably only has cogs 60 on the circumference of the pinion 18 that engage with the teeth 58 of the rack 16, although the pinion 18 could have cogs 60 along the entire circumference of the pinion 18. The pinion 18 has an axis of rotation that is transverse to the axis of rotation of the handle 12. The pinion 18 is connected with a shaft 64 centrally located at the pinion 18 that will rotate with the pinion 18. The shaft 64 operates a latch which releases an access cover for a vehicle or the like, as discussed below. The shaft 64 preferably has a square cross section, although any non-circular cross section can be used whereby the shaft 64 will rotate with rotation of the pinion. The teeth 58 of the rack 16 will move vertically with the rack 16 when the handle 12 is horizontally rotated, thereby causing the cogs 60 on the pinion 18 to move downward. Moreover, the downward movement of the cogs 60 will cause rotation of the integral pinion 18 and shaft 64. The shaft 64 preferably rotates between 45 and 90 degrees. The angle of rotation of the shaft 64 is determined by the distance that the teeth 58 extend along the side 59 of the rack 16. As the length of teeth 58 along the side of the rack 16 rises, the angle of rotation of the shaft 64 will rise. Therefore, the rotary paddle handle 10 is preferably at the closed position when the shaft 64 is not rotated and at the open position when the shaft 64 has been fully rotated. A back plate 61 preferably covers the rack 16, the spring 50 and the pinion 18, thereby keeping the rack 16 in the track 46. Furthermore, an annular guide 63 is attached to the back plate 61. The shaft 64 is located within the annular guide 63, wherein the shaft 64 extends through and is allowed to rotate within the annular guide 63. Moreover, the annular guide 63 supports the connected shaft 64 and pinion 18 in a horizontal and vertical position adjacent the rack 16.

In operation, the rotary motion applied to the handle 12 and the tab 14 when the handle 12 is lifted will cause the tab 14 to move downward. The rack 16 and teeth 58 will also move downward from the closed position to the open position, thereby causing the pinion 18 and shaft 64 to rotate. The rotary motion applied to the shaft 64 operates an associated latch which releases the entryway. When the handle 12 is released, the biasing force of the spring 50 forces the rack 16 upward so as to rotate the pinion 18 and return the handle 12 to the closed position.

In the illustrated example, the handle 12 has a lock housing 68 on a first side 70 of the handle 12. The lock housing 68 has a front face 72 with a semi-circular top 74 extending vertically upward from the bottom portion 34 of the front wall 28 of the handle 12 when the front wall 28 has a substantially constant slope. A shell 76 of the lock housing 68 extends between the front face 72 of the lock housing 68 to the front wall 28 of the handle 12. A key lock 78, which selectively prevents rotary motion of the handle 12, is placed within the lock housing 68. The key lock 78 has a key entry 80 whereby a key (not shown) can be inserted into the key lock 78 through the key entry 80 to selectively prevent rotary motion of the handle 12 by connecting the handle 12 to the housing 22 to prevent upward rotation of the handle 12. However, because the tab 14 is not fixed to the rack 16, the rack 16 is still free to move vertically. Therefore, the rack 16 can be moved to the open position from the back of the housing 22, thereby providing an additional safety feature. In the event the handle 12 is locked in position by the key lock 78, the rotary paddle handle 10 can be opened from the interior of the vehicle in order to open the access cover for the vehicle.

The reference numeral 10*a* (FIGS. 7–10) generally designates another embodiment of the present invention. Since rotary paddle handle 10*a* is similar to the previously described rotary paddle handle 10, similar parts appearing in FIGS. 3–6 and FIGS. 7–10, respectively, are represented by the same, corresponding reference number, except for the suffix "a" in the numerals of the latter. The rotary paddle handle 10*a* of the second embodiment includes the front wall 28*a* with the middle portion 36*a* having a parabolic cross section. The rotary paddle handle 10*a* has the lock housing 68*a* located within the front wall 28*a* of the handle 12*a*. The top of the lock housing 68*a* is aligned with the front wall 28*a* of the handle 12*a*, and a bottom wall of the lock housing 68*a* is circular and extends horizontally from the key lock 78*a* to the front wall 28*a*. Furthermore, the front face 20*a* of the housing 22*a* is preferably slanted backwards.

Figure 2:
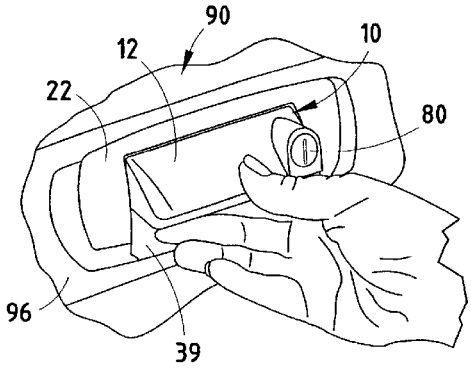
FIG. 2 is an enlarged fragmentary perspective view of the rotary paddle handle, shown being lifted to an open position.

As best illustrated in FIGS. 1–3, the illustrated rotary paddle handle assembly 10 is shown mounted in a cover or cap 90 that is shaped to enclose the open bed 91 of an associated pickup truck 92. Cover 90 includes a forward portion or end 93 disposed adjacent to the cab 94 of pickup truck 92, which includes at least one hinge 95 (FIG. 3) that pivotally mounts cover 90 to pickup truck 92. The illustrated cover 90 also includes a rearward portion or end 96 disposed adjacent to the tailgate 97 of pickup truck 92 in which rotary paddle handle assembly 10 is mounted. A pair of releasable latches 98 are mounted on opposite sides of cover 90 adjacent the rearward end 96 thereof, and have a generally conventional construction, comprising a laterally shiftable actuating arm 99 which locks and unlocks latches 98. A pair of flexible lines or cables 100 interconnect the actuating arms 99 of latches 98 with the shaft 64 of rotary paddle handle assembly 10, such that rotation of shaft 64 tenses flexible lines 100, and shifts latches 98 to their unlocked position. The illustrated cover 90 also includes at least one lift 101 to facilitate shifting cover 90 to its open position, and a closure strap 102 to assist in shifting cover 90 to its closed position.

In operation, to shift cover 90 to its open position, the user grasps the handle 12 of paddle handle assembly 10 by inserting his/her fingers into the downwardly opening finger recess 39 and pulling upwardly in a manner which causes handle 12 to rotate inwardly as shown in FIG. 2. The rotation of handle 12 pivots shaft 64, thereby tensing flexible lines 100 to release latches 98, and unlock cover 90 from pickup truck 92, such that the rearward end 96 of cover 90 can be pivoted upwardly about hinges 95. The downwardly opening finger recess 39 of handle 12 permits the user to both unlock the releasable latches 98 and manually shift cover 90 upwardly to the open position shown in FIG. 3 with a single upward lifting motion. Lift 101 counterbalances the weight of cover 90 to reduce the amount of force needed to shift cover 90 to the open position. To close cover 90, the user simply grasps strap 102 and pulls downwardly on the same to pivot the rear end 96 of cover 90 downward into engagement with the upper edge or rim of the pickup truck bed 91. Latches 98 abut and engage mating latch portions (not shown) adjacent the upper edge of pickup truck bed 91 to lock cover 90 securely in the closed position, as shown in FIG. 1.

As best illustrated in FIGS. 1–2, rotary paddle handle assembly 10 has a flush mount construction, and visually replicates entryway handles on the vehicle 92, such as the illustrated tailgate latch 105, and door latches 106. As a result, rotary paddle handle assembly 10 has a custom fit or factory made appearance to enhance the overall look of the pickup truck 92 and cover 90. As previously noted, latches 98 can be released from the interior of the pickup truck bed 91 even when lock 80 is in the locked position, by simply tensing one of the flexible lines 100, thereby providing a safety feature.

Rotary paddle handle assembly 10 may be used in other orientations and applications, as will be apparent to those skilled in the art. For example, rotary paddle handle assembly 10 can be used on a closure or door for a vehicle, such as a console, glove box, spare tire well, etc. In a horizontally opening closure, rotary paddle handle assembly 10 is preferably positioned opposite the mounting hinges, with the finger recess 39 opening away from the hinges to permit the user to both unlock the associated latches (not shown) and manually sift the closure horizontally sideways to an open position with a single lateral motion.

The above description is considered that of the preferred embodiments only. Modification of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

What is claimed is:

1. In a vehicle cover having at least one releasable latch to selectively secure said cover to an associated vehicle, the improvement of a rotary paddle handle assembly, comprising:

a handle pivotally mounted to said cover for rotation about a generally horizontal axis, and including a protruding tab;

a vertically reciprocating rack disposed adjacent said tab;

a pinion engaged with said rack; and a shaft operably connected with said pinion, extending horizontally in a direction generally perpendicular to said horizontal axis of said handle, and operably connected with said releasable latch, such that when said handle is lifted, said tab abuts said vertically reciprocating rack to shift the same vertically and rotate said pinion and said shaft axially for unlocking said releasable latch to permit opening said cover.

2. A cover as set forth in claim 1, wherein:

said cover is shaped to enclose an open pickup truck bed.

3. A cover as set forth in claim 2, wherein:

said cover includes a forward portion with at least one hinge adapted to pivotally mount said cover to the vehicle.

4. A cover as set forth in claim 3, wherein:

said cover includes a rearward portion in which said rotary paddle handle assembly is mounted, such that when said releasable latch is unlocked, said cover may be opened by pivoting said rearward portion of said cover upwardly about said hinge.

5. A cover as set forth in claim 4, wherein:

said handle includes a downwardly opening finger recess to facilitate both unlocking said releasable latch and opening said cover with a single upward lifting motion.

6. A cover as set forth in claim 5, wherein:

said rotary paddle handle has a flush mount construction which visually replicates entryway handles on the vehicle.

7. A cover as set forth in claim 6, wherein:

said rotary paddle handle assembly includes a key lock to selectively prevent rotation of said handle in a locked position.

8. A cover as set forth in claim 7, wherein:

said rack is supported to permit vertical shifting of said rack and rotation of said shaft when said key lock is in the locked position to permit opening said cover from within the pickup truck bed when said key lock is in the locked position.

9. A cover as set forth in claim 8, including:

a flexible line having one end thereof connected with said shaft, and an opposite end thereof connected with said releasable latch, whereby rotation of said shaft tenses said flexible line to unlock said releasable latch.

10. A cover as set forth in claim 9, including:

at least one lift to assist in raising said cover to an open position.

11. A cover as set forth in claim 10, wherein:

said rotary paddle handle assembly includes a spring which biases said rack to a normally locked position.

12. A cover as set forth in claim 11, wherein:

said rotary paddle handle includes a housing mounted flush in the rear portion of said cover, and having an internal cavity in which said handle rotates.

13. A cover as set forth in claim 12, wherein:

said handle is pivotally mounted in said housing by a pin.

14. A cover as set forth in claim 13, wherein:

said rack includes a plurality of teeth arranged along a side edge thereof which engage cogs on said pinion.

15. A cover as set forth in claim 14, wherein:

said rack includes a notch at an upper end in which said tab is received.

16. A cover as set forth in claim 1, wherein:

said cover includes a rearward portion in which said rotary paddle handle assembly is mounted, such that when said releasable latch is unlocked, said cover may be opened by shifting said rearward portion of said cover upwardly.

17. A cover as set forth in claim 1, wherein:

said handle includes a downwardly opening finger recess to facilitate both unlocking said releasable latch and opening said cover with a single upward lifting motion.

18. A cover as set forth in claim 1, wherein:

said rotary paddle handle assembly has a flush mount construction which visually replicates entryway handles on the vehicle.

19. A cover as set forth in claim 1, wherein:

said rotary paddle handle assembly includes a key lock to selectively prevent rotation of said handle in a locked position.

20. A cover as set forth in claim 19, wherein:

said rack is supported to permit vertical shifting of said rack and rotation of said shaft when said key lock is in the locked position to permit opening said cover from within the pickup truck bed when said key lock is in the locked position.

21. A cover as set forth in claim 1, including:

a flexible line having one end thereof connected with said shaft, and an opposite end thereof connected with said releasable latch, whereby rotation of said shaft tenses said flexible line to unlock said releasable latch.

22. A cover as set forth in claim 1, including:

at least one lift to assist in shifting said cover to an open position.

23. A rotary paddle handle assembly for vehicle covers having at least one releasable latch to selectively secure said cover to an associated vehicle, comprising:

a housing having a flush mount construction for mounting to the cover, and including a front face with a recess therein:

a handle pivotally mounted in the recess of said housing for rotation about a generally horizontal axis, and including a downwardly opening finger recess and a rearwardly protruding tab;

a vertically reciprocating rack disposed adjacent said tab;

a pinion engaged with said rack; and a shaft operably connected with said pinion, extending horizontally in a direction generally perpendicular to said horizontal axis of said handle, and configured to be operably connected with the releasable latch, such that when said handle is lifted, said tab abuts said vertically reciprocating rack to shift the same vertically and rotate said pinion and said shaft axially for unlocking the releasable latch to permit opening the cover.

24. A rotary paddle handle assembly as set forth in claim 23, wherein:

said finger recess facilitates both unlocking said releasable latch and opening the cover with a single upward lifting motion.

25. A rotary paddle handle assembly as set forth in claim 24, wherein:

said rotary paddle handle replicates entryway handles on the vehicle.

26. A rotary paddle handle assembly as set forth in claim 25, wherein:

said rotary paddle handle assembly includes a key lock to selectively prevent rotation of said handle in a locked position.

27. A rotary paddle handle assembly as set forth in claim 26, wherein:

said rack is supported to permit vertical shifting of said rack and rotation of said shaft when said key lock is in the locked position to permit opening of the cover from within the pickup truck bed when said key lock is in the locked position.

28. A rotary paddle handle assembly as set forth in claim 27, including:

a flexible line having one end thereof connected with said shaft, and an opposite end thereof adapted for connection with the releasable latch, whereby rotation of said shaft tenses said flexible line to unlock the releasable latch.

29. A rotary paddle handle assembly as set forth in claim 28, wherein:

said rotary paddle handle assembly includes:

a spring which biases said rack to a normally locked position; and a housing adapted to be connected with the cover, and having an internal cavity in which said handle rotates.

30. In a vehicle access closure having at least one releasable latch to selectively secure said closure to an associated vehicle, the improvement of a rotary paddle handle assembly, comprising:

a handle pivotally mounted to said cover for rotation about an axis, and including a protruding tab;

a reciprocating rack disposed adjacent said tab;

a pinion engaged with said rack; and a shaft operably connected with said pinion, extending generally perpendicular to said axis of said handle, and operably connected with said releasable latch, such that when said handle is rotated, said tab abuts said reciprocating rack to shift the same longitudinally and rotate said pinion and said shaft axially for unlocking said releasable latch to permit opening said closure.

31. An access closure as set forth in claim 30, wherein:

said handle includes an outwardly opening finger recess to facilitate both unlocking said releasable latch and opening said closure with a single motion.

32. An access closure as set forth in claim 31, wherein:

said rotary paddle handle has a flush mount construction which visually replicates entryway handles on the vehicle.

33. An access closure as set forth in claim 32, wherein:

said rotary paddle handle assembly includes a key lock to selectively prevent rotation of said handle in a locked position.

34. An access closure as set forth in claim 33, wherein:

said rack is supported to permit shifting of said rack and rotation of said shaft when said key lock is in the locked position to permit opening of said closure from within the vehicle when said key lock is in the locked position.

35. An access closure as set forth in claim 34, including:

a flexible line having one end thereof connected with said shaft, and an opposite end thereof connected with said releasable latch, whereby rotation of said shaft tenses said flexible line to unlock said releasable latch.

36. A rotary paddle handle assembly for vehicle covers and the like of the type having at least one releasable latch to selectively secure said cover to an associated vehicle, comprising:

a handle pivotally adapted to mount to the cover for rotation about a generally horizontal axis, and including a protruding tab;

a vertically reciprocating rack disposed adjacent said tab;

a pinion engaged with said rack;

a shaft operably connected with said pinion, extending horizontally in a direction generally perpendicular to said horizontal axis of said handle, and configured to be operably connected with the releasable latch, such that when said handle is lifted, said tab abuts said vertically reciprocating rack to shift the same vertically and rotate said pinion and said shaft axially for unlocking the releasable latch to permit opening the cover; and wherein said handle includes a downwardly opening finger recess to facilitate both unlocking said releasable latch and opening the cover with a single upward lifting motion; and said rotary paddle handle has a flush mount construction which visually replicates entryway handles on the vehicle.

37. A rotary paddle handle assembly as set forth in claim 36, wherein:

said rotary paddle handle assembly includes a key lock to selectively prevent rotation of said handle in a locked position.

38. A rotary paddle handle assembly as set forth in claim 36, wherein:

said rack is supported to permit vertical shifting of said rack and rotation of said shaft when said key lock is in the locked position to permit opening of the cover from within the pickup truck bed when said key lock is in the locked position.

* * * * *